166-274 SR
FIP7912 XR 4,086,961

United States Patent [19] [11] 4,086,961
Braden, Jr. et al. [45] May 2, 1978

[54] METHOD OF OIL RECOVERY EMPLOYING ENRICHED GAS DRIVE WITH CONTROL OF EVOLVED GAS

[75] Inventors: William B. Braden, Jr., Houston, Tex.; George H. Agnew, Calgary, Canada

[73] Assignees: Texaco Inc., New York, N.Y.; Texaco Exploration Canada Ltd., Calgary, Canada

[21] Appl. No.: 758,268

[22] Filed: Jan. 10, 1977

[51] Int. Cl.[2] ..... E21B 43/20; E21B 43/22
[52] U.S. Cl. ..... 166/245; 166/268; 166/274
[58] Field of Search ..... 166/273, 274, 252, 266, 166/267, 245, 268, 263

[56] References Cited

U.S. PATENT DOCUMENTS

| | | | |
|---|---|---|---|
| 2,994,373 | 8/1961 | Stone | 166/274 X |
| 3,157,230 | 11/1964 | Connally, Jr. et al. | 166/274 |
| 3,223,157 | 12/1965 | Lacey et al. | 166/273 X |
| 3,254,712 | 6/1966 | Sharp | 166/273 X |
| 3,256,933 | 6/1966 | Murphree et al. | 166/273 X |
| 3,268,000 | 8/1966 | Dumore | 166/274 X |
| 3,288,212 | 11/1966 | O'Brien et al. | 166/273 X |
| 3,354,953 | 11/1967 | Morse | 166/274 X |
| 3,854,532 | 12/1974 | Braden, Jr. | 166/273 X |

*Primary Examiner*—Stephen J. Novosad
*Attorney, Agent, or Firm*—Thomas H. Whaley; Carl G. Ries; Charles L. Bauer

[57] ABSTRACT

A method for the recovery of hydrocarbons from a subterranean hydrocarbon-bearing reservoir by an enriched gas drive wherein lean gas, evolved from the miscible transition zone, is produced ahead of the miscible transition zone and reinjected behind the solvent injection point whereby excessive gas production is utilized and a drive agent miscible with the solvent is provided to displace the reservoir fluids through the reservoir to a production well from which they are produced.

9 Claims, 2 Drawing Figures

CONTROL OF EVOLVED GAS

ENRICHED GAS DRIVE

CONTROL OF EVOLVED GAS

METHOD OF OIL RECOVERY EMPLOYING ENRICHED GAS DRIVE WITH CONTROL OF EVOLVED GAS

FIELD OF THE INVENTION

This invention relates to a method for the recovery of hydrocarbons from a subterranean reservoir utilizing an enriched gas drive wherein lean gas evolved from the miscible transition zone is produced ahead of the solvent-oil transition zone and reinjected behind the point of solvent injection, thereby utilizing the produced lean gas as a drive agent to produce the reservoir and minimizing the amount of lean gas reaching the producing wells.

PRIOR ART

In the recovery of oil from subterranean reservoirs, one method that is utilized to enhance recovery is the use of a solvent for the oil to wash the oil out of the reservoir. When the solvent employed can mix completely with the oil to form a single phase the term "miscible flooding" is applied to the process.

The effectiveness of the miscible recovery process is based on the fact that a two-phase system within the reservoir between the solvent displacing agent and the oil is eliminated at the reservoir conditions of temperature and pressure, thereby eliminating interfacial tension and hence the retentive capillary forces. When these retentive forces are present in flooding operations where the displacing agent and the reservoir oil are not miscible with each other, but exist as two phases in the reservoir, recovery efficiency is significantly reduced.

A miscible flood process may employ either "first contact" miscibility or "conditional" miscibility. In the former type the injected solvent is miscible upon first contact with the oil. Typically, first contact miscible processes utilize a solvent liquefiable at reservoir conditions with the solvent being rich in intermediate hydrocarbons, that is, hydrocarbons having from two to six carbon atoms in the molecule, such as propane or liquid petroleum gas (LPG). Since it is not generally economical to use a barrel of solvent to produce a barrel of oil, the solvent is injected as a slug in an amount sufficient to establish a miscible transition zone at the "leading edge" of the solvent slug between the solvent and the reservoir hydrocarbons. Thereafter, a less costly drive agent is injected that may or may not be miscible with the solvent at the "trailing edge" of the solvent slug. For example, if the drive agent employed is natural gas or methane, "trailing edge" miscibility generally will exist at reservoir conditions.

In a "conditional miscible" flood, a gas drive is employed wherein the gas injected contains a reduced amount of a solvent. Where miscibility is established in the reservoir by the solvent in the gas being absorbed by the reservoir hydrocarbon or oil, thereby building up a miscible transition zone of an oil bank rich in solvent ahead of the drive gas, the process is also termed an "enriched gas drive". The enriched gas drive generally utilizes a lean hydrocarbon gaseous solvent of a mixture of methane and intermediate hydrocarbons having from two to six carbon atoms in the molecule. Propane or LPG are the intermediates usually employed. The minimum amount of solvent necessary to establish miscibility in an enriched gas drive depends upon reservoir conditions of temperature and pressure and the physical and chemical characteristics of the hydrocarbons in the reservoir. This amount can be determined by means of laboratory displacement tests or equilibrium studies of the PVT behavior of the hydrocarbon components which tests are well-known in the art. For example, a method for determining composition of an enriched gas that has conditional miscibility with the reservoir hydrocarbons at the pressure and temperature of the reservoir is set forth in U.S. Pat. No. 3,854,532. In this patent there is taught that for a given set of conditions of temperature and pressure for a reservoir, there exists a mixture of hydrocarbons having a composition such that upon successive contacts with the reservoir hydrocarbons or oil, the mixture will form with the reservoir hydrocarbon or oil, a single fluid phase by the absorption of the intermediate hydrocarbons of the mixture. This patent also describes the process in terms of a three-component composition diagram, often referred to as a ternary diagram which depicts the phase relations between the various components for given reservoir conditions of temperature and pressure.

One of the difficulties of the enriched gas drive process relates to the fact that the injected solvent is gaseous at reservoir conditions and miscibility occurs by the continued absorption of the intermediate hydrocarbons into the oil. Concurrent with this absorption the remaining gas primarily methane from the injected gas mixture, being more mobile is displaced through the reservoir ahead of the solvent transition zone, to be later produced via production wells. As the process continues, more and more gas is displaced through the reservoir and as production continues, the produced fluids become very high in gas content as evidenced by increasing gas-oil ratios. Eventually, as the permeability of the reservoir to gas increases because of the increased gas saturation, very high produced gas-oil ratios are realized, and very little liquid hydrocarbon or oil is displaced and produced. Under these conditions undesirable gas override may also occur in the reservoir, with consequent little movement or production of the reservoir hydrocarbons. These undesirable conditions may necessitate shutting in the producing wells.

By our invention in an enriched gas drive the lean gas is produced ahead of the formed miscible transition zone and is reinjected behind the injection point for the solvent, thereby utilizing the gas evolved from the miscible transition zone and further providing a drive agent for the enriched gas drive.

DESCRIPTION OF THE INVENTION

In its broadest aspect this invention relates to an improved enriched gas drive for the recovery of reservoir hydrocarbons wherein the lean gas evolved from a miscible transition zone is utilized as a drive agent. In one embodiment of the invention the process is applied to a dipping reservoir. In this case the reservoir is penetrated by at least one crestal injection well or a well completed behind the solvent bank. The reservoir also is penetrated by at least one production well that is completed into the lower portion of the hydrocarbon-saturated zone. In operation, a gaseous solvent, that is conditionally miscible with the reservoir hydrocarbons, is injected via the injection well into the reservoir.

Upon contact with the reservoir hydrocarbons the intermediate hydrocarbons of the solvent such as propane are absorbed by the reservoir hydrocarbons, thereby forming a miscible transition zone between the injected solvent and the reservoir hydrocarbons. With the absorption of the intermediates the remaining portion of the hydrocarbon solvent becomes leaner and the gas, principally methane, and other relatively noncondensable gases, which are not absorbed and being more mobile are displaced through the reservoir, in the direction of the producing well. In the conventional operation, as set forth above, this may result in excessive gas production with little liquid hydrocarbon production.

By the invention, after the lean gas starts to accumulate in the reservoir ahead of the transition zone between the solvent and the reservoir hydrocarbons, and an increase in the gas-oil ratio becomes evident, a third well means is provided that penetrates the reservoir ahead of the formed transition zone. Its completion provides for production from only the upper horizon of the reservoir. Location of this third well means can be determined by known techniques as applied to reservoirs. Thereafter, this well means is produced, its production being principally gas. The produced gas being very lean in composition is compressed, without separation into its components, and reinjected via a fourth well means behind the point of injection of the solvent material. Thus, the injected gas serves as a drive agent to displace the injected solvent and the oil through the reservoir. In addition, a trailing edge miscible zone is created within the reservoir that serves to improve recovery of the lighter hydrocarbons in the reservoir, both present initially and also from the injected solvent. By the method of operation, gas breakthrough into the producing well is controlled so that improved displacement of the liquid hydrocarbons is attained because of the more favorable relative permeability conditions in the reservoir.

Figure 1:
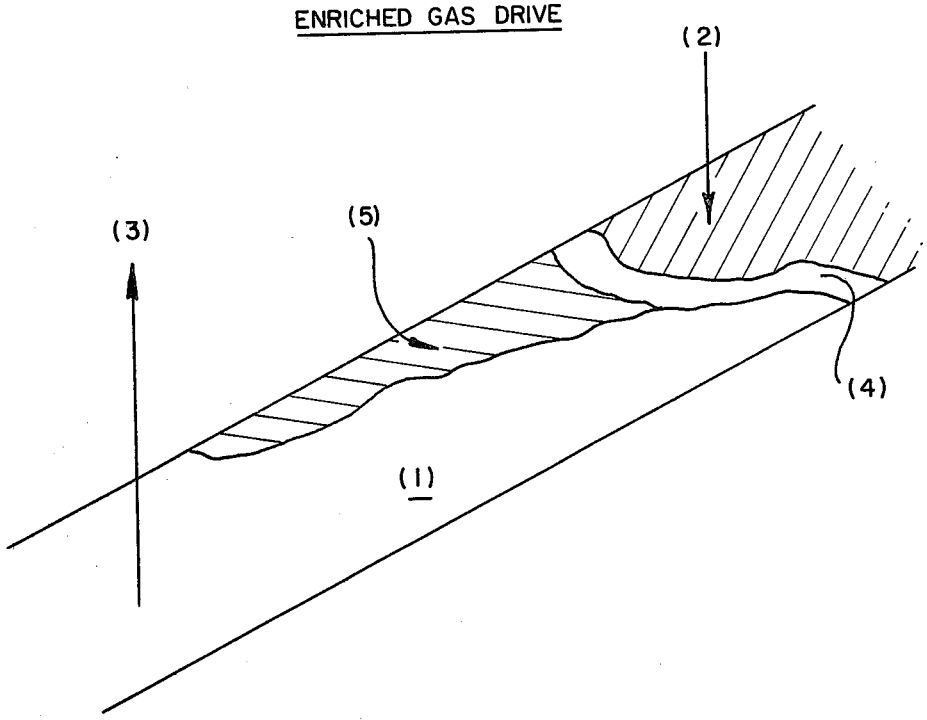
FIG. 1 depicts the application of an enriched gas drive process to a dipping reservoir.

One embodiment of the invention may be illustrated by referring to the accompanying figures. FIG. 1 depicts a schematic version of a conventional enriched gas drive as applied to a dipping reservoir (1). In this method, the enriched gas solvent, whose composition has been previously established, is injected via injection well (2) completed by conventional means in the updip portion of the oil column of the reservoir or to the gas/oil interface. A production well (3) is completed downdip from which the displaced reservoir fluids are produced. An enriched gas solvent is injected via the injection well in amounts sufficient to form by conditional miscibility a transition zone (4) with the reservoir hydrocarbons. During the operation the gas, primarily methane, resulting from the solvent slug after having been stripped of its intermediates by their absorption in the oil, moves at the frontal portion of the transition zone (5). Production of reservoir fluids from production well (3) occurs with increasing gas-oil ratio. With an excessive gas-oil ratio, production of reservoir liquid hydrocarbons diminishes to a point when further operation becomes uneconomical.

Figure 2:
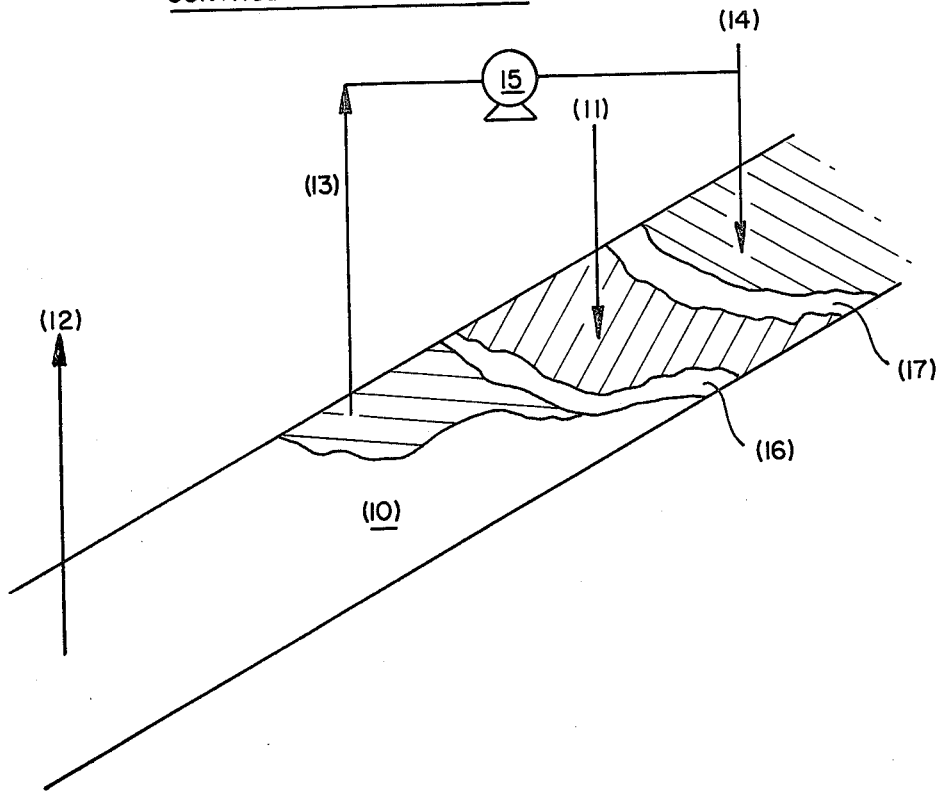
FIG. 2 depicts the advances in the art in accordance with this invention.

FIG. 2 depicts the improvement of the instant invention as applied to a dipping reservoir (10), traversed by an injection well (11) and a production well (12). Shown are two additional wells completed in the reservoir for the practice of the invention. Well (13) is completed ahead of the formed transition zone (16) between the injected solvent and the reservoir hydrocarbons. The well is packed off such that production therefrom is restricted to the upper horizon of the reservoir if override or gravity segregation has occurred. Well (14) is completed behind the injection well and serves as an injection well for the produced and then reinjected gas. With increased gas-oil ratio from the production well (12), well (13) is produced in a manner such that its production is principally gas which is thereafter compressed by compressor means (15) and reinjected behind the solvent injection well (11) via well (14). Thus, there is provided a drive agent for the process, which drive agent is the reinjected gas. By the method of operation there is no phase change between the reinjected gas and the solvent and a second transition zone (17) is formed at the trailing edge of the solvent slug. In this manner, the enriched gas miscible slug process is transformed into a slug driven process, utilizing the excess amounts of produced lean gas. Alternately, the produced gas can be recombined with intermediate hydrocarbon solvent to continue an enriched gas drive.

The gaseous solvent for the process may be any hydrocarbon comprising methane or natural gas and at least one intermediate hydrocarbon having from two to six carbon atoms in the molecule. Its composition may be determined according to laboratory procedures as described heretofore and set forth in U.S. Pat. No. 3,854,532. The solvent is injected in amounts sufficient to establish the desired miscible transition zone. Generally, for an enriched gas drive, the amount of pore volumes of solvent injected is in the range of 3% to 50%. While the solvent is usually injected alone, in instances where improved mobility control is sought, water or brine, either thickened or unthickened, may be injected simultaneously or alternately with the solvent. The use of thickeners, such as polyacrylamides, to increase the viscosity of aqueous liquids thereby improving mobility control is well-known in the art.

In summary, in accordance with the invention a reservoir is produced by an enriched gas drive until an undesirably high gas-oil ratio occurs. Thereafter, additional production of the reservoir is undertaken from the reservoir by a well means located ahead of the miscible transition front. The location of the well means and method of completion are such that the principal production therefrom is the gas resulting from the mechanism of the enriched gas drive. This gas production is cycled and reinjected behind the original injection well whereby the injected gas provides a drive mechanism to displace the miscible zone and the oil through the reservoir. In some instances it may be necessary or desirable to supplement the reinjected gas with make-up gas such as methane, natural gas, carbon dioxide, nitrogen, air, or flue gas. Additionally, this produced gas may be combined with solvent and injected as enriched gas via the original injection well.

We claim:

1. A method of oil recovery from a subterranean hydrocarbon-bearing dipping reservoir traversed by a first injection well means completed in the upper horizon of said reservoir and a second production well means completed in the lower horizon of said reservoir wherein a solvent that is gaseous at the reservoir conditions of temperature and pressure and conditionally miscible with the reservoir hydrocarbon is injected via said first injection well means into said reservoir to form a miscible transition zone with said reservoir hydrocarbon, and reservoir fluids are produced via said second production well means the improvement comprising:

(a) providing a third well means intermediate between said first injection well means and said second production well means for producing fluids from said reservoir, (b) providing a fourth well means behind said first injection well means for injecting fluids into said reservoir, (c) producing fluids comprising principally gas from said third well means when the ratio of produced gas to produced oil from said second production well means has become undesirably high, (d) compressing said produced gas to a pressure above the reservoir pressure of said reservoir and injecting said gas into said reservoir via said fourth well means thereby providing a drive agent to displace said reservoir fluids through said reservoir toward said second production well means.

2. The method of claim 1 wherein said third well means is completed into the upper portion of said reservoir.

3. The method of claim 1 wherein said third well means is located between said injection well means and said production well means in spaced relation to said miscible transition zone.

4. The method of claim 1 wherein said fourth well means comprises a well completed across the horizon of said reservoir.

5. The method of claim 1 wherein said solvent comprises a mixture of methane and at least one hydrocarbon having from two to six carbon atoms per molecule.

6. The method of claim 5 wherein said mixture comprises methane and liquid petroleum gas.

7. The method of claim 1 wherein water, brine, thickened water, thickened brine and mixtures thereof are injected simultaneously or alternately with said solvent.

8. The method of claim 1 wherein methane, natural gas, carbon dioxide, nitrogen, flue gas and mixtures thereof is added to said produced gas prior to injection into said reservoir.

9. The method of claim 1 wherein said produced gas is combined with solvent and reinjected as the gaseous solvent for a continued enriched gas drive.

* * * * *